US009020179B2

(12) United States Patent
Akino et al.

(10) Patent No.: US 9,020,179 B2
(45) Date of Patent: Apr. 28, 2015

(54) UNIDIRECTIONAL CONDENSER MICROPHONE AND DIRECTIONALITY VARYING MEMBER FOR THE SAME

(71) Applicants: Hiroshi Akino, Tokyo (JP); Noriko Matsui, Tokyo (JP)

(72) Inventors: Hiroshi Akino, Tokyo (JP); Noriko Matsui, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 25 days.

(21) Appl. No.: 13/860,114

(22) Filed: Apr. 10, 2013

(65) Prior Publication Data

US 2013/0272558 A1 Oct. 17, 2013

(30) Foreign Application Priority Data

Apr. 16, 2012 (JP) ..... 2012-092659

(51) Int. Cl.

| | |
|---|---|
| ***H04R 25/00*** | (2006.01) |
| ***H04R 1/32*** | (2006.01) |
| *H04R 1/08* | (2006.01) |
| *H04R 19/02* | (2006.01) |

(52) U.S. Cl.

CPC ..... *H04R 1/326* (2013.01); *H04R 1/086* (2013.01); *H04R 19/02* (2013.01)

(58) Field of Classification Search

CPC ..... H04R 19/04; H04R 1/086; H04R 1/38; H04R 2410/07; H04R 9/08; B81B 2201/0257

USPC ..... 381/355, 356, 358, 359

See application file for complete search history.

(56) References Cited

U.S. PATENT DOCUMENTS

| | | | | | |
|---|---|---|---|---|---|
| 3,770,911 | A * | 11/1973 | Knowles et al. | ..... | 381/313 |
| 3,876,843 | A * | 4/1975 | Moen | ..... | 381/313 |
| 4,051,330 | A * | 9/1977 | Cole | ..... | 381/313 |
| 4,694,499 | A * | 9/1987 | Bartlett | ..... | 381/357 |
| 4,789,044 | A * | 12/1988 | Akino | ..... | 181/158 |
| 4,862,507 | A * | 8/1989 | Woodard | ..... | 381/358 |
| 6,876,749 | B1 * | 4/2005 | Killion et al. | ..... | 381/122 |
| 7,627,132 | B2 * | 12/2009 | Anderson | ..... | 381/356 |
| 8,218,806 | B2 * | 7/2012 | Akino et al. | ..... | 381/355 |
| 8,488,828 | B2 * | 7/2013 | Akino | ..... | 381/356 |
| 8,538,057 | B2 * | 9/2013 | Ikeda et al. | ..... | 381/356 |

FOREIGN PATENT DOCUMENTS

| | | | |
|---|---|---|---|
| JP | 2000295687 A | * | 10/2000 |
| JP | 2010-288047 A | | 12/2010 |

OTHER PUBLICATIONS

JP2000295687A. Translation Document.*

* cited by examiner

*Primary Examiner* — Davetta W Goins
*Assistant Examiner* — Phylesha Dabney
(74) *Attorney, Agent, or Firm* — Whitham Curtis Christofferson & Cook, PC

(57) ABSTRACT

A unidirectional condenser microphone includes a front acoustic terminal disposed on a forward portion of a microphone case, a rear acoustic terminal disposed on the outer circumferential surface of the microphone case, and a directionality varying member disposed on the outer circumferential surface of the microphone case. The directionality varying member switches between a first position and a second position. The directionality varying member covers the rear acoustic terminal at the first position while the rear acoustic terminal is opened at the second position. The front acoustic terminal is displaced ahead of the front surface of the microphone case, and the directionality varying member is in close contact with the outer circumferential surface of the microphone case.

10 Claims, 17 Drawing Sheets

UNIDIRECTIONAL CONDENSER MICROPHONE AND DIRECTIONALITY VARYING MEMBER FOR THE SAME

BACKGROUND OF THE INVENTION

1. Technical Field

The present invention relates to a unidirectional condenser microphone of which the directionality is selectable in accordance with the usage and a directionality varying member for the unidirectional condenser microphone. The directionality varying member can vary the directionality of the unidirectional condenser microphone.

2. Background Art

A condenser microphone may be unidirectional, bidirectional, or nondirectional. Unidirectional condenser microphones may have a sub-cardioid directional pattern that is sensitive over a wide range or a hyper-cardioid directional pattern that is sensitive over a narrow range. These unidirectional condenser microphones are appropriately selected in accordance with the usage.

For example, a unidirectional condenser microphone having a normal cardioid pattern may be selected for picking up the voice of a single speaker with a single microphone. A unidirectional condenser microphone having a sub-cardioid pattern is suitable for picking up the voices of multiple speakers with a single microphone. A unidirectional condenser microphone having a hyper-cardioid pattern is suitable for picking up the voice of a specified speaker while preventing the pickup of the voices of other speakers and surrounding noise.

Usually, the directional pattern of a unidirectional condenser microphone is established during a production process. Thus, the selection of a unidirectional condenser microphone having the most appropriate directional pattern for the usage and usage environment of the microphone requires the preparation of multiple unidirectional condenser microphones having different directional patterns.

The directional characteristics of a unidirectional condenser microphone depend on the acoustic resistance and the distance between the front acoustic terminal and the rear acoustic terminal. The acoustic resistance can be adjusted by varying the thickness of the material of the acoustic resistor. For example, compression of the material causes an increase in the acoustic resistance. An increase in the acoustic resistance near the rear acoustic terminal leads to a sub-cardioid pattern, whereas a decrease in the acoustic resistance due to low compression of the material of the acoustic resistor leads to a cardioid pattern. A microphone is known which includes an acoustic resistor having a thickness variable with a screw to readily adjust the directional pattern of the microphone (for example, refer to Japanese Unexamined Patent Application Publication No. 2010-288047).

A unidirectional condenser microphone having a hyper-cardioid pattern is different from a unidirectional condenser microphone having a cardioid pattern in that the unidirectional condenser microphone has a larger distance between the front acoustic terminal and the rear acoustic terminal. A structure is known which has a cylindrical member (hereinafter referred to as "cap") attached to the front surface of the microphone case in order to increase the distance between the front and rear acoustic terminals. The cap attached to the front surface of the microphone case causes the front acoustic terminal to be positioned more forward than usual, i.e., more forward than that of a microphone having a cardioid directional pattern. Such a cap is composed of a material other than that of the microphone and is detachable from the microphone. A microphone equipped with such a cap has a hyper-cardioid directional pattern, while a microphone with the cap removed has a cardioid directional pattern.

SUMMARY OF THE INVENTION

As described above, a microphone with predetermined directional characteristics adjustable by varying the thickness of the acoustic resistor is produced by adjusting the acoustic resistor during a production process. The thickness of the acoustic resistor cannot be readily varied after the production of the microphone, or for example, while in use by a user.

The cap is an impervious resin member. Reducing the space in front of the microphone case with such an impervious member causes resonance in the space, impairing the frequency characteristics. The prevention of such impairment requires a vent (e.g., slit) to be formed in the circumference of the cap. A cap having a vent does not function as an acoustic resistor.

As described above, there are various known configurations for varying the directional characteristics of a unidirectional condenser microphone.

No unidirectional condenser microphone is known which can be switched between directional patterns, i.e., from a cardioid pattern to a sub-cardioid pattern or from a cardioid pattern to a hyper-cardioid pattern, by replacement of a single member in use.

An object of the present invention, which has been conceived in light of the problems described above, is to provide a unidirectional condenser microphone of which the directional characteristics is selectable in accordance with the usage and a directionality varying member for the condenser microphone.

A unidirectional condenser microphone according the present invention comprises a front acoustic terminal disposed on a forward portion of a microphone case accommodating a condenser microphone unit; a rear acoustic terminal disposed on the outer circumferential surface of the microphone case; and a directionality varying member disposed on the outer circumferential surface of the microphone case, wherein the directionality varying member is disposed on the outer circumferential surface of the microphone case, the directionality varying member being switchable between a first position and a second position, the directionality varying member covering the rear acoustic terminal at the first position, the rear acoustic terminal being opened at the second position.

A directionality varying member attached to a unidirectional condenser microphone according to the present invention comprises a microphone case including a front acoustic terminal disposed on a forward portion of the microphone case; and a condenser microphone unit accommodated in the microphone case, wherein the directionality varying member is disposed on the outer circumferential surface of the microphone case and switches between a first position and a second position, the directionality varying member covering a rear acoustic terminal disposed on the outer circumferential surface of the microphone case at the first position, the rear acoustic terminal being opened at the second position.

The present invention provides a unidirectional condenser microphone and a directionality varying member thereof that enable adjustment of the acoustic resistor and the distance between the forward and rear acoustic terminals using a single member and selection of the directional characteristics in accordance with usage and usage environment.

DESCRIPTION OF THE PREFERRED EMBODIMENTS

Figure 1A:
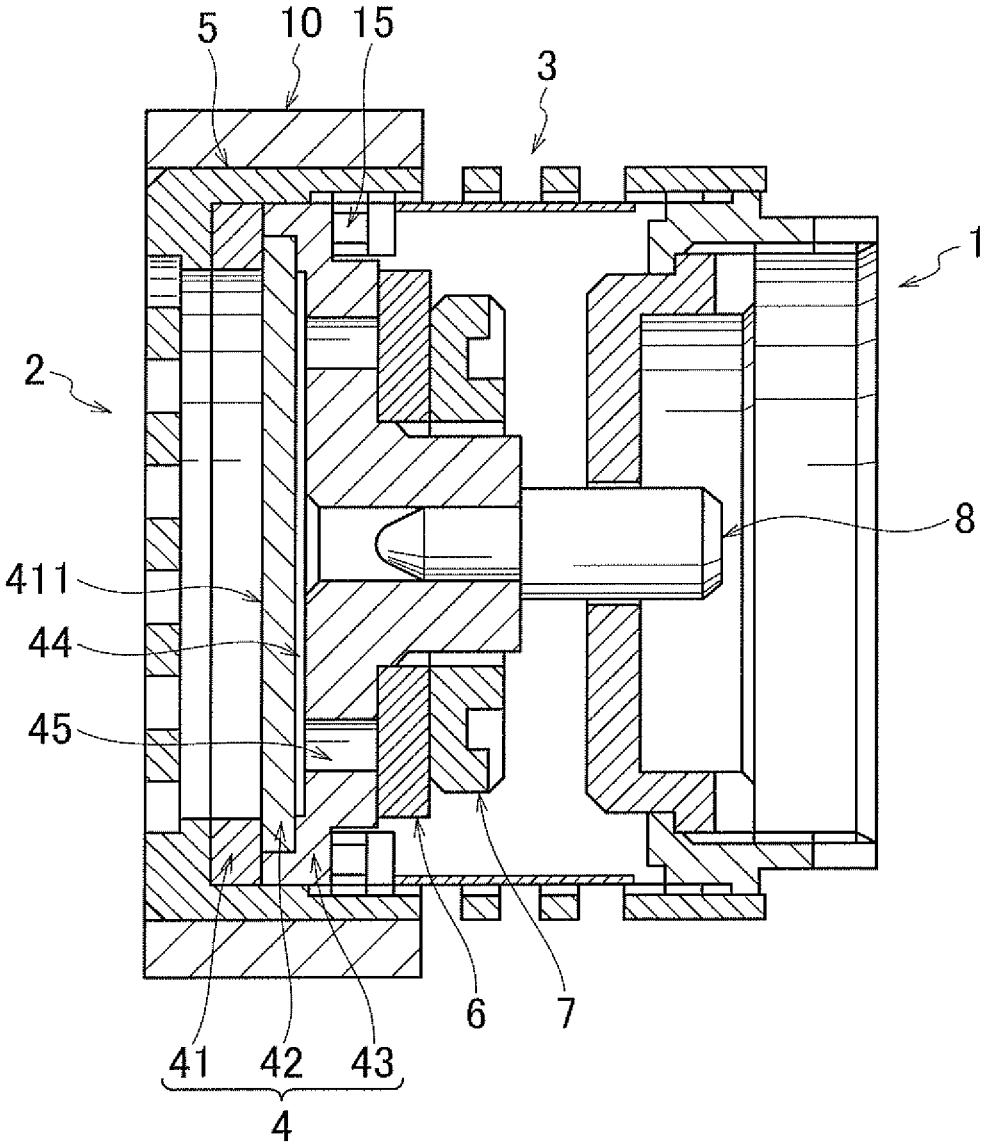
FIG. 1A is a longitudinal cross-sectional view of a unidirectional condenser microphone and a directionality varying member thereof according to a first embodiment of the present invention.
Figure 1B:
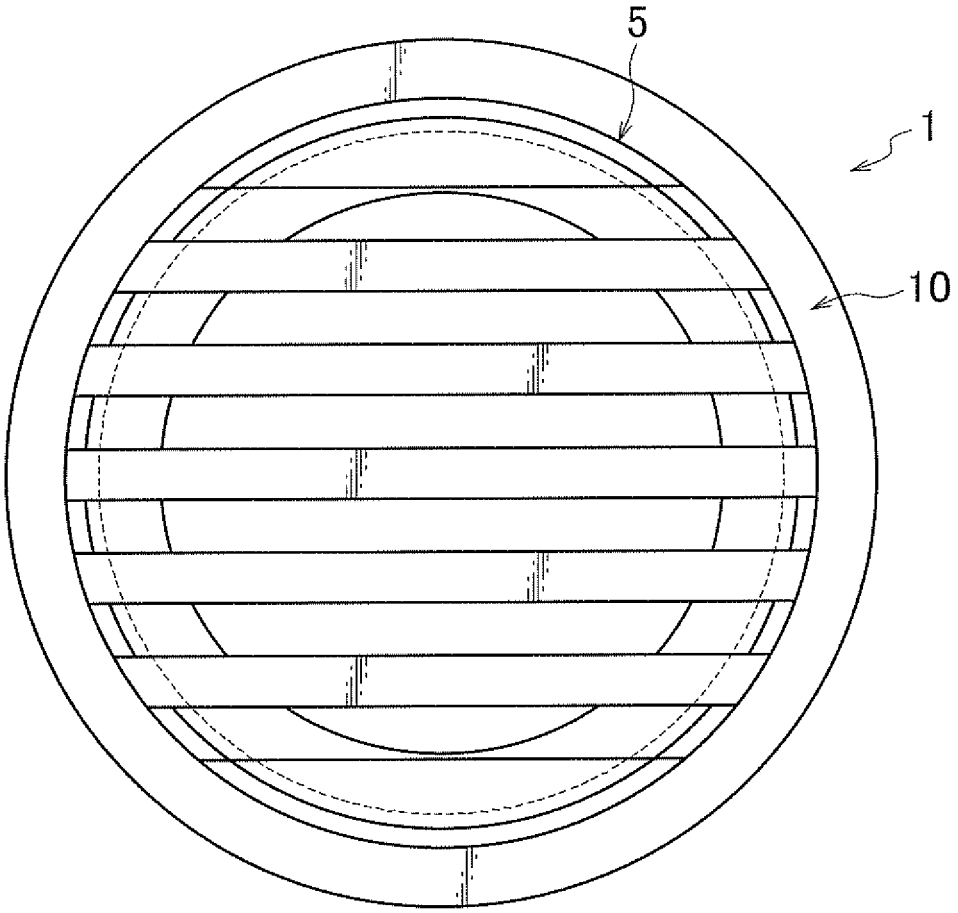
FIG. 1B is a front view of the first embodiment.

A unidirectional condenser microphone and a directionality varying member of the condenser microphone according to embodiments of the present invention will now be described with reference to the accompanying drawings. Referring to FIGS. 1A and 1B, a condenser microphone 1 includes a cylindrical microphone case 5 composed of metal and a condenser microphone unit 4 accommodated in the microphone case 5. The condenser microphone unit 4 includes a diaphragm ring 41, a diaphragm 411 stretched tightly on the diaphragm ring 41, an insulation washer 43, and a stator 42 supported by the insulation washer 43. The diaphragm 411 faces the stator 42 with a spacer having an appropriate thickness disposed therebetween. A gap, which corresponds to the thickness of the spacer, is formed between the diaphragm 411 and the stator 42.

A holding ring 15 is fit into the inner circumference of the microphone case 5. The holding ring 15 urges forward (toward the left in the FIG. 1) the outer circumferential portion of the insulation washer 43, the stator 42, the spacer, the diaphragm 411, and the diaphragm ring 41 to hold these components in tight contact with each other inside the microphone case 5.

An air chamber 44 is formed between the back side of the stator 42 and the insulation washer 43. The air chamber 44 is in communication with the exterior via a communication hole 45 formed in the insulation washer 43. An acoustic resistor 6 is disposed on the back side of the insulation washer 43 covering the communication hole 45. Threads are formed on the outer circumference of a cylindrical portion protruding from the central area of the back side of the insulation washer 43, and the threads are engaged with a nut 7.

The nut 7 urges the acoustic resistor 6 toward the communication hole 45. Thus, the thickness of the acoustic resistor 6 is adjusted by the position of the nut 7. The position of the nut 7 can be adjusted in an assembly step. In the assembly step of the condenser microphone 1, the thickness of the acoustic resistor 6 is varied by adjusting the nut 7 to acquire a desired cardioid directional pattern for the unidirectional condenser microphone.

An extraction electrode 8 which is electrically connected to the stator 42 via a wire (not shown) is disposed in the center hole in the cylindrical portion of the insulation washer 43. The extraction electrode 8 is a bar electrode disposed at the substantial center of the rear opening in the microphone case 5. The extraction electrode 8 is electrically connected to a circuit board (not shown). Vibration of the diaphragm 411 generated in response to the reception of acoustic waves varies the capacitance between the diaphragm 411 and the stator 42. The variation in the capacitance is converted to electric signals. The output impedance of the electric signals is significantly high. Thus, the circuit board contains an electric circuit, such as an impedance converter.

Slits are formed on the front surface of the microphone case 5, as illustrated in FIG. 1B. The slits shape the front surface of the microphone case 5 into a front acoustic terminal 2. The acoustic waves that pass through the front acoustic terminal 2 vibrate the diaphragm 411 and are converted to audio signals. As illustrated in FIG. 1A, slits are formed on the circumferential side surface of the microphone case 5. The side surface of the microphone case 5 on which the slits are formed serves as a rear acoustic terminal 3.

The unidirectional condenser microphone according to this embodiment, which is illustrated in FIGS. 1A and 1B, differs from a known unidirectional condenser microphone in that a directionality varying member 10 is provided on the outer circumference of the microphone case 5. The shape of the directionality varying member 10 may be a hollow tube with an inner circumference slightly smaller than the outer circumference of the microphone case 5. The directionality varying member 10 is composed of an elastic porous substance, such as elastic sintered plastic, that functions as an acoustic resistor. The elasticity of the directionality varying member 10 enables the directionality varying member 10 to come into close contact with the outer circumferential surface of the microphone case 5.

In the embodiment shown in these drawings, the directionality varying member 10 disposed on the microphone case 5 can slide in the longitudinal direction of the microphone case 5. The directionality varying member 10 slides between a position where it covers the rear acoustic terminal 3 and a position where it opens the rear acoustic terminal 3 and protrudes forward from the front surface of the microphone case 5. Positioning the directionality varying member 10 such that it protrudes from the front surface of the microphone case 5 achieves practically the same advantages as moving the front acoustic terminal 2 forward. Referring to FIGS. 1A and 1B, the directionality varying member 10 is disposed between the two positions such that it opens the rear acoustic terminal 3 and does not protrude from the front surface of the microphone case 5.

The directionality varying member 10 may be detachable from the microphone case 5.

Figure 2:
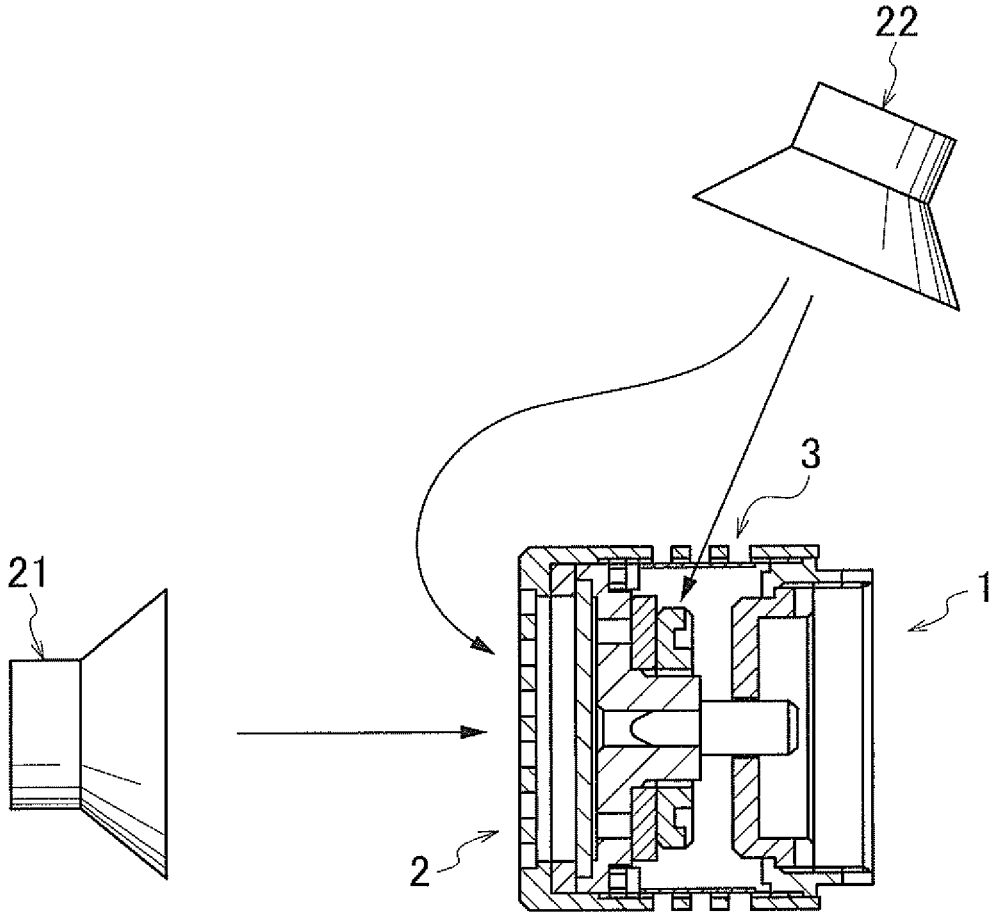
FIG. 2 is a model diagram illustrating the principle of sound pickup of the unidirectional condenser microphone.

As illustrated in FIG. 1A, the condenser microphone 1 has a normal unidirectionality if the directionality varying member 10 opens the rear acoustic terminal 3 and does not protrude from the front surface of the microphone case 5. FIG. 2 illustrates the principle of sound pickup of such a unidirectional condenser microphone. As illustrated in FIG. 2, a sound source 21 is disposed ahead of the front acoustic terminal 2 of the condenser microphone 1 along the axial direction, and a sound source 22 is disposed on the side of the rear acoustic terminal 3. The sound from the sound source 21 enters the front acoustic terminal 2 and vibrates the diaphragm 411. The vibration of the diaphragm 411 causes a variation in the capacitance between the diaphragm 411 and the stator 42. Then, electric signals corresponding to the variation are output. The sound from the sound source 22 enters the front acoustic terminal 2 and the rear acoustic terminal 3. The sounds from the different terminals cancel out the vibration of the diaphragm 411. As a result, the level of the output electric signals is low. Thus, the output is high in response to the sound from the sound source 21, which is disposed ahead of the front acoustic terminal 2, whereas the output is low in response to the sound source 22, which is one of the sound sources disposed at a position other than that of the sound source 21.

Figure 3:
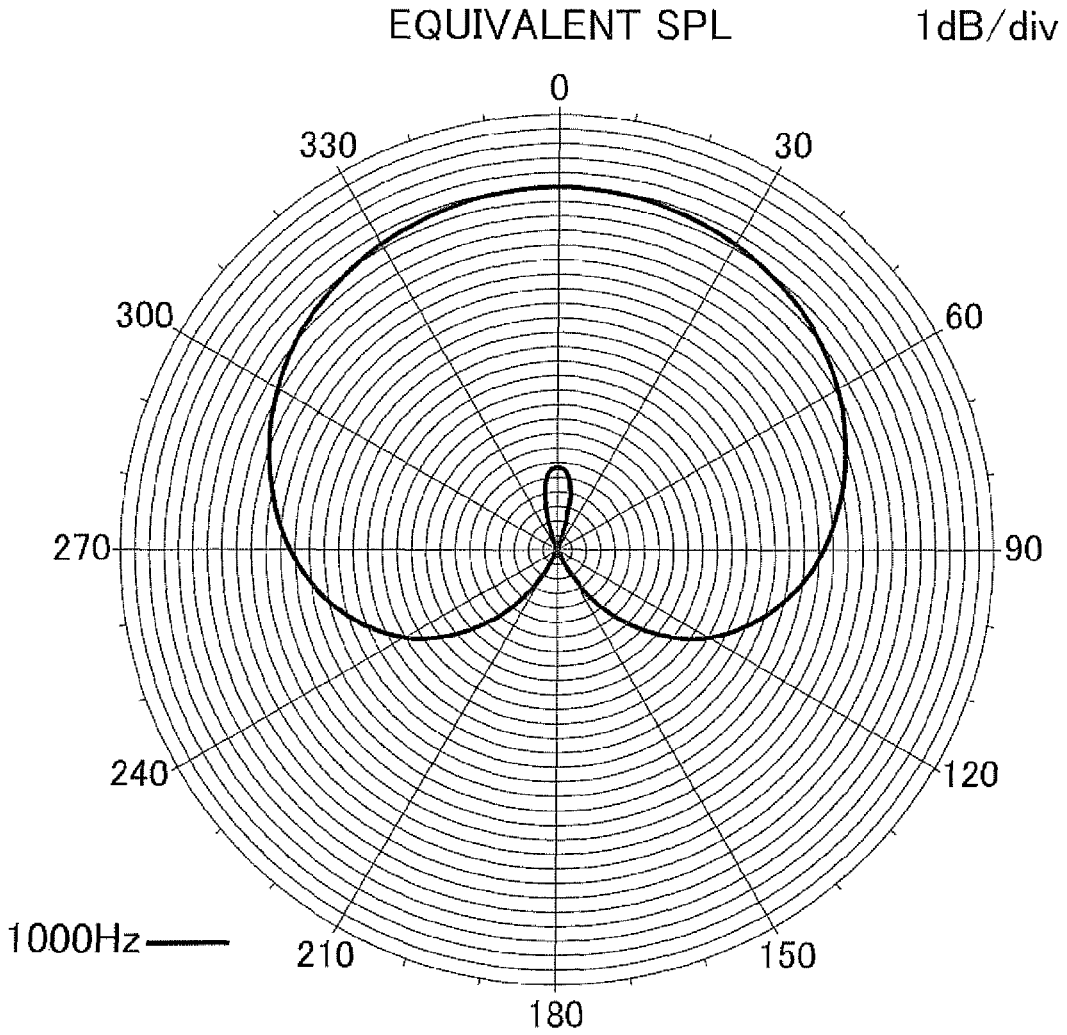
FIG. 3 is a directional characteristics diagram according to the first embodiment.
Figure 4:
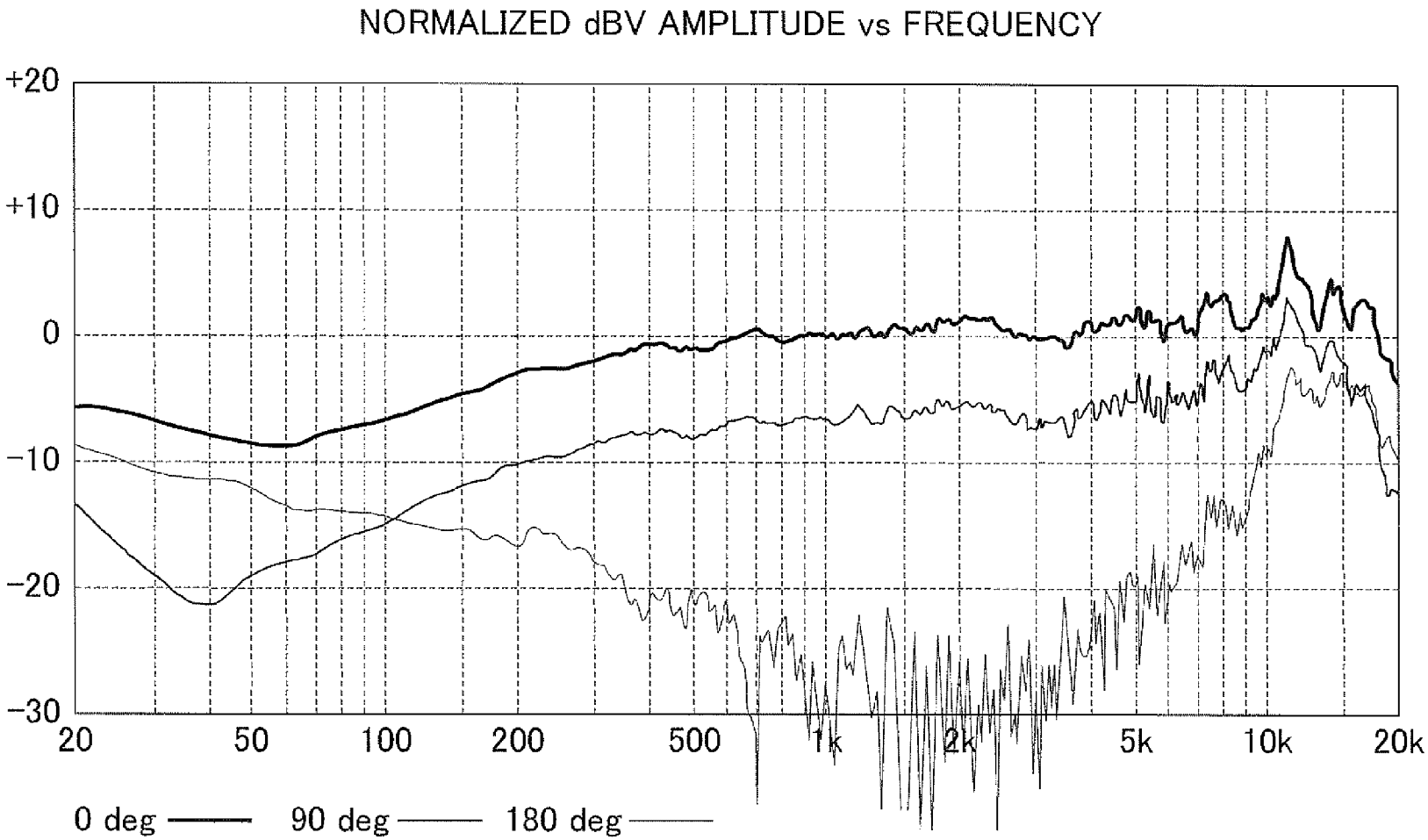
FIG. 4 is a frequency response diagram according to the first embodiment.

FIG. 3 illustrates the directional characteristics of the condenser microphone 1 having the directionality varying member 10 disposed at the position illustrated in FIG. 1A, and FIG. 4 illustrates the frequency response characteristics of the condenser microphone 1. The condenser microphone 1 illustrated in FIG. 1A is unidirectional as a result of the front acoustic terminal 2 and the rear acoustic terminal 3 functioning effectively, and the directional pattern is a cardioid, as illustrated in FIG. 3.

The condenser microphone 1 having the directional characteristics of a sub-cardioid pattern as a result of the displacement of the directionality varying member 10 will now be described with reference to FIGS. 5A and 5B. In this case, the directionality varying member 10 covers the rear acoustic terminal 3.

As described above, the directionality varying member 10 functions as an acoustic resistor. The elasticity of the directionality varying member 10 enables the directionality varying member 10 to come into close contact with the outer circumferential surface of the microphone case 5. The directionality varying member 10 covering the rear acoustic terminal 3 allows sound to enter the rear acoustic terminal 3 via the directionality varying member 10. The acoustic resistance of the rear acoustic terminal 3 affects the acoustic characteristics.

Figure 5A:
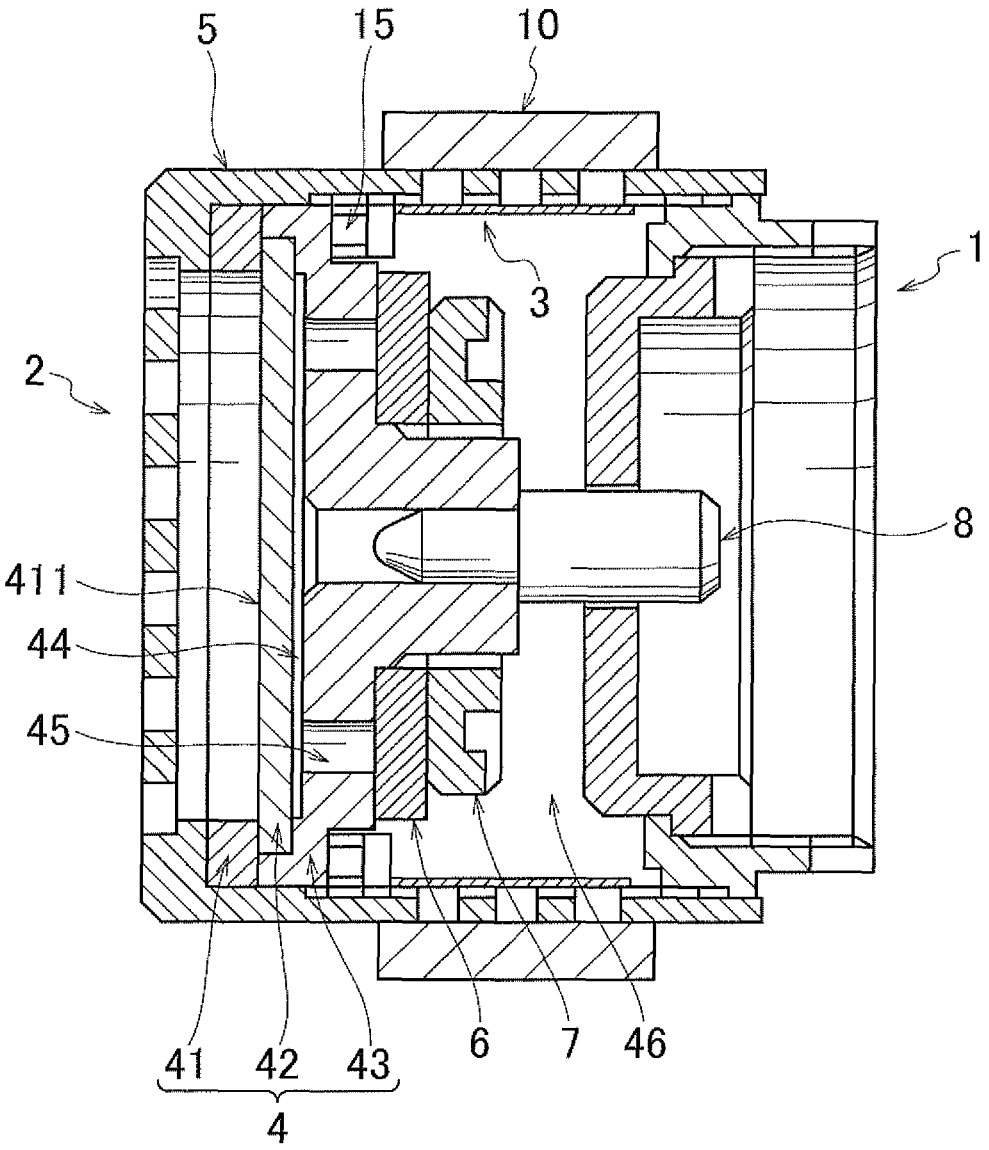
FIG. 5A is a longitudinal cross-sectional view of a unidirectional condenser microphone according to a first variation of the first embodiment.

As illustrated in FIG. 5A, the acoustic resistor 6 is disposed inside the condenser microphone 1. The unidirectionality of the condenser microphone 1 is established by the acoustic resistance r1 of the acoustic resistor 6 and the acoustic capacitance s1 of the air chamber 44 on the back side of the insulation washer 43. The condenser microphone 1 has a series-connected resistance of the acoustic resistance r1 of the acoustic resistor 6 and the acoustic resistance r1' of the directionality varying member 10.

Covering the rear acoustic terminal 3 with the directionality varying member 10 defines an interior space functioning as an air chamber in the microphone case 5 on the back side of the diaphragm 411. That is, the rear space defined by the acoustic resistor 6, the nut 7, and the directionality varying member 10 serves as an air chamber 46. The condenser microphone 1 has a parallel-connected acoustic capacitance of the acoustic capacitance s1 of the air chamber 44 and the acoustic capacitance s1' of the air chamber 46. Such an incremental acoustic capacitance s1' enhances the driving force of the nondirectional component of the condenser microphone 1. In other words, the capacity of the air chamber on the back side of the diaphragm 411 increases, while the bidirectional component entering the rear acoustic terminal 3 decreases.

Figure 6:
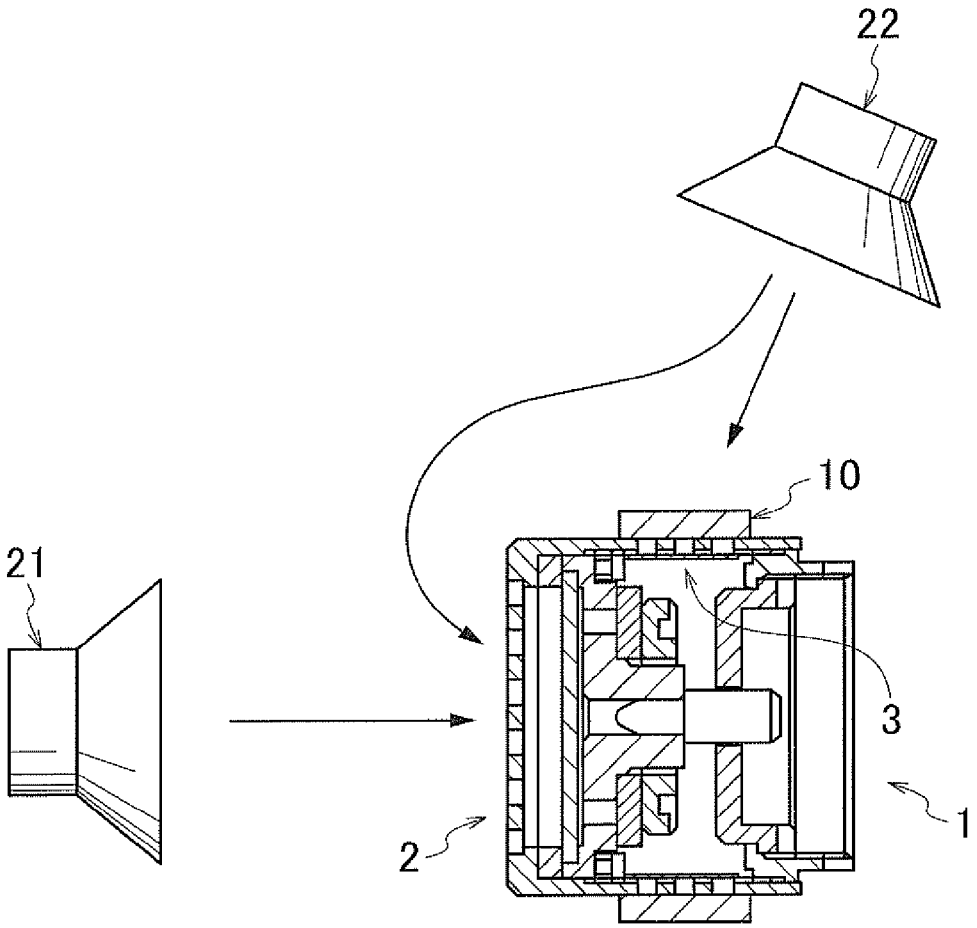
FIG. 6 is a model diagram illustrating the principle of sound pickup of the unidirectional condenser microphone according to the first variation.

FIG. 6 illustrates the principle of sound pickup of the condenser microphone 1 including the directionality varying member 10 at the position illustrated in FIG. 5A. The sound source 21 is disposed ahead of the front acoustic terminal 2 of the condenser microphone 1, and the sound source 22 is disposed on the side of the rear acoustic terminal 3. The sound from the sound source 21 enters the front acoustic terminal 2 and is output as electric signals. The sound from the sound source 22 entering the rear acoustic terminal 3 is damped by the acoustic resistance of the directionality varying member 10. The sound from the sound source 22 that enters the front acoustic terminal 2 is the same as that illustrated in FIG. 2.

Figure 7:
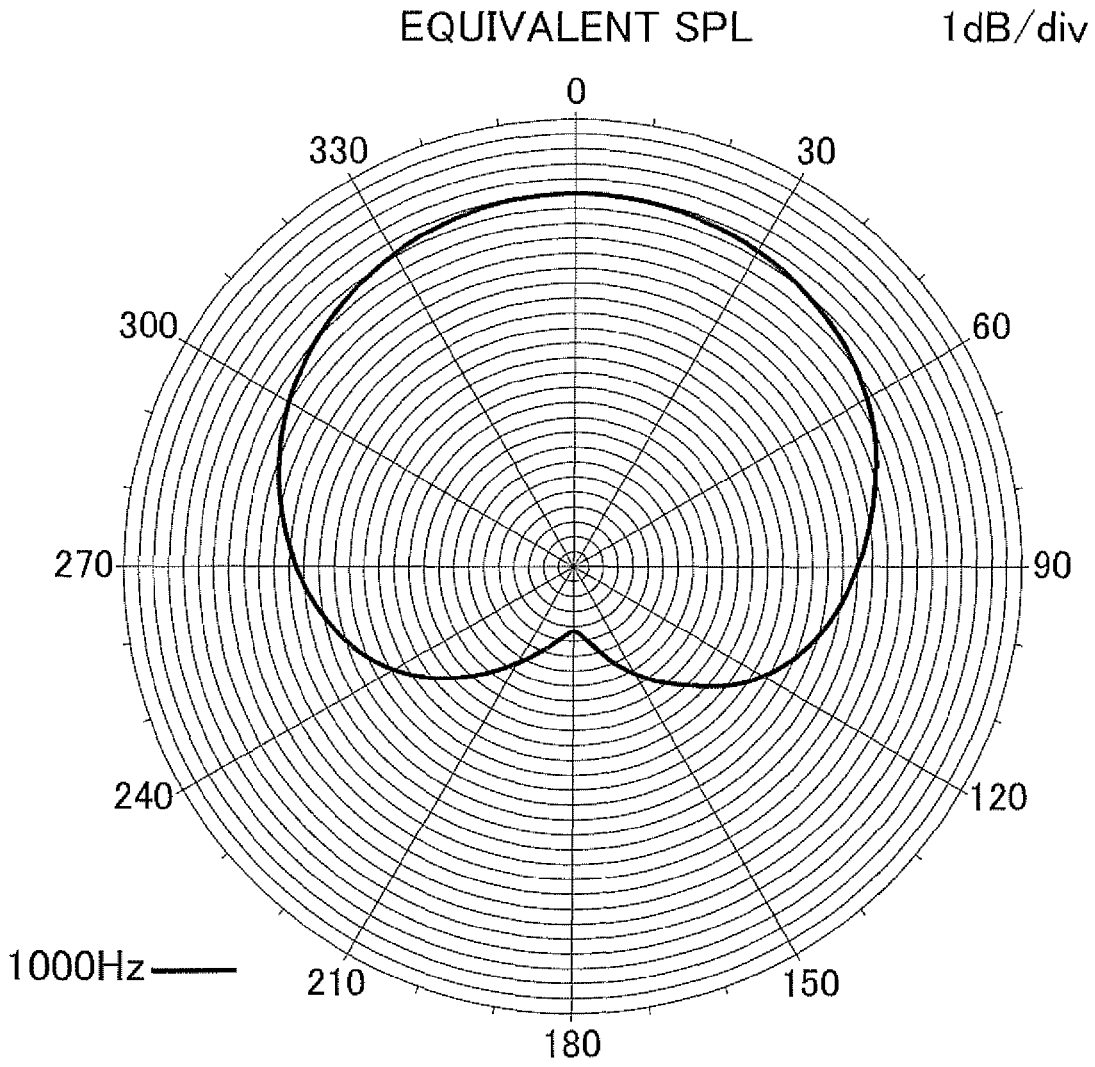
FIG. 7 is a directional characteristics diagram according to the first variation.
Figure 8:
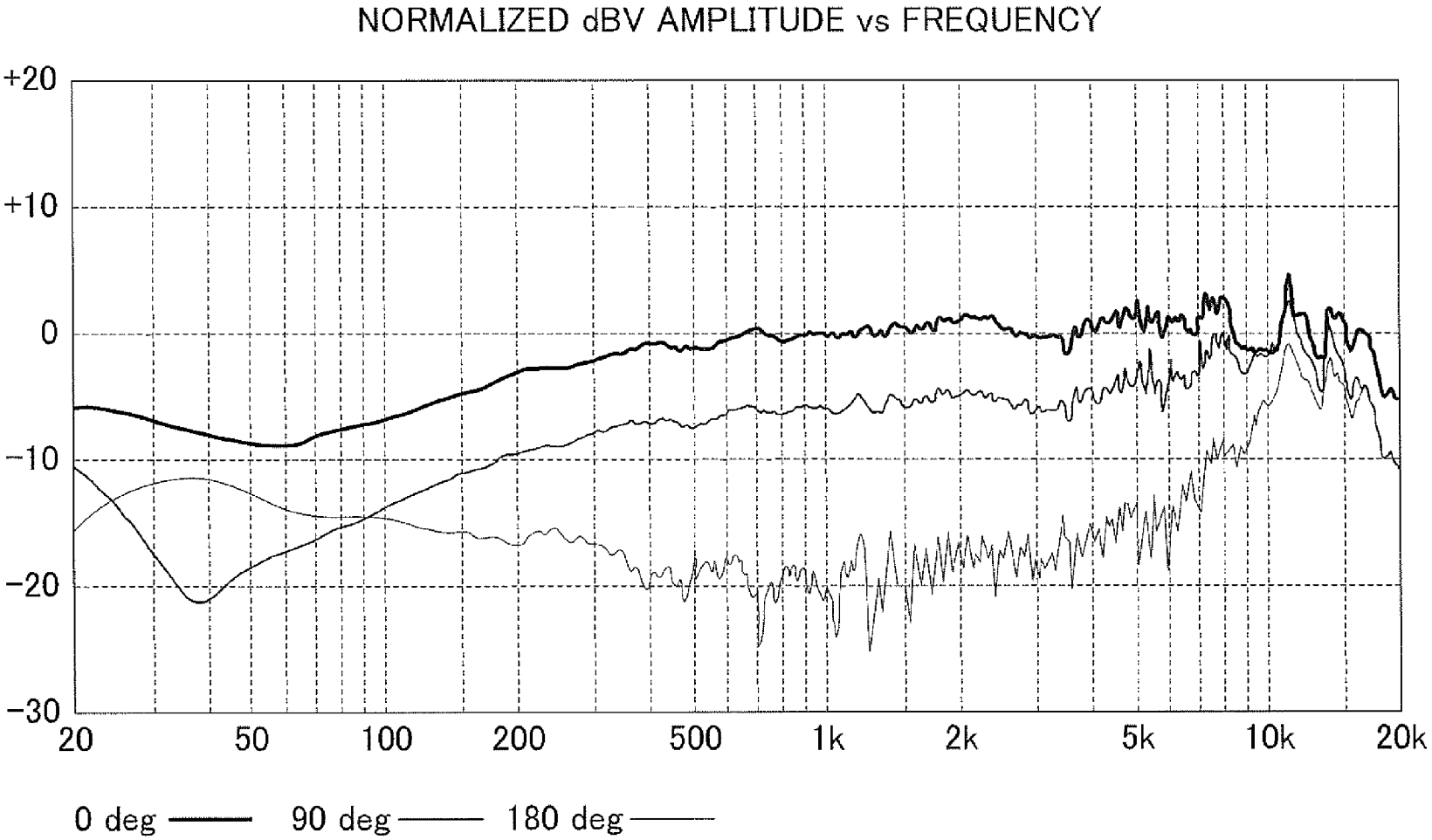
FIG. 8 is a frequency response diagram according to the first variation.

FIG. 7 illustrates the directional characteristics of the condenser microphone 1 having a directionality varying member 10 is disposed at the position illustrated in FIG. 5A, and FIG. 8 illustrates the frequency response characteristics of the condenser microphone 1. The directional characteristics of a sub-cardioid pattern, which is illustrated in FIG. 7, is sensitive over a wide range compared to the directional characteristics of a cardioid pattern illustrated in FIG. 3. The directionality varying member 10 covering the rear acoustic terminal 3, as illustrated in FIG. 5A, allows the sound from the sound source 21 and the sound from other sound sources to enter the front acoustic terminal 2 at a predetermined level. Then, output signals corresponding to the level of the sound are output. The damped sound entering the rear acoustic terminal 3 is not at a level high enough to cancel out the sound from the sound source 22 that has entered through the front acoustic terminal 2. As a result, the forward portion of the condenser microphone 1 is sensitive over a wider range. The condenser microphone 1 including the directionality varying member 10, which functions as an acoustic resistor and covers the rear acoustic terminal 3, may not be nondirectional but will have directionality of a sub-cardioid pattern that is sensitive over a range wider than the normal unidirectional pattern.

In general, an increase in the acoustic resistance results in a decrease in the sensitivity. For example, an increase in the acoustic resistance of the acoustic resistor 6 achieved by moving the nut 7 and compressing the acoustic resistor 6 varies the directional characteristics while decreasing the sensitivity. Thus, the directionality of the condenser microphone 1 illustrated in FIG. 5A can be changed to a sub-cardioid pattern by covering the rear acoustic terminal 3 with the directionality varying member 10, without compression of the acoustic resistor 6. The directional characteristics can be exclusively changed while maintaining the sensitivity and the frequency response, regardless of the addition of acoustic resistance due to the directionality varying member 10. FIG. 8 illustrates the frequency response characteristics of the condenser microphone 1 illustrated in FIG. 5A. As apparent from the frequency response characteristics illustrated in FIG. 8 in comparison with the frequency response characteristics illustrated in FIG. 4, the sensitivity and the frequency response characteristics are substantially maintained. Thus, the condenser microphone 1 illustrated in FIG. 5A effectively picks up voices of multiple speakers.

Figure 9A:
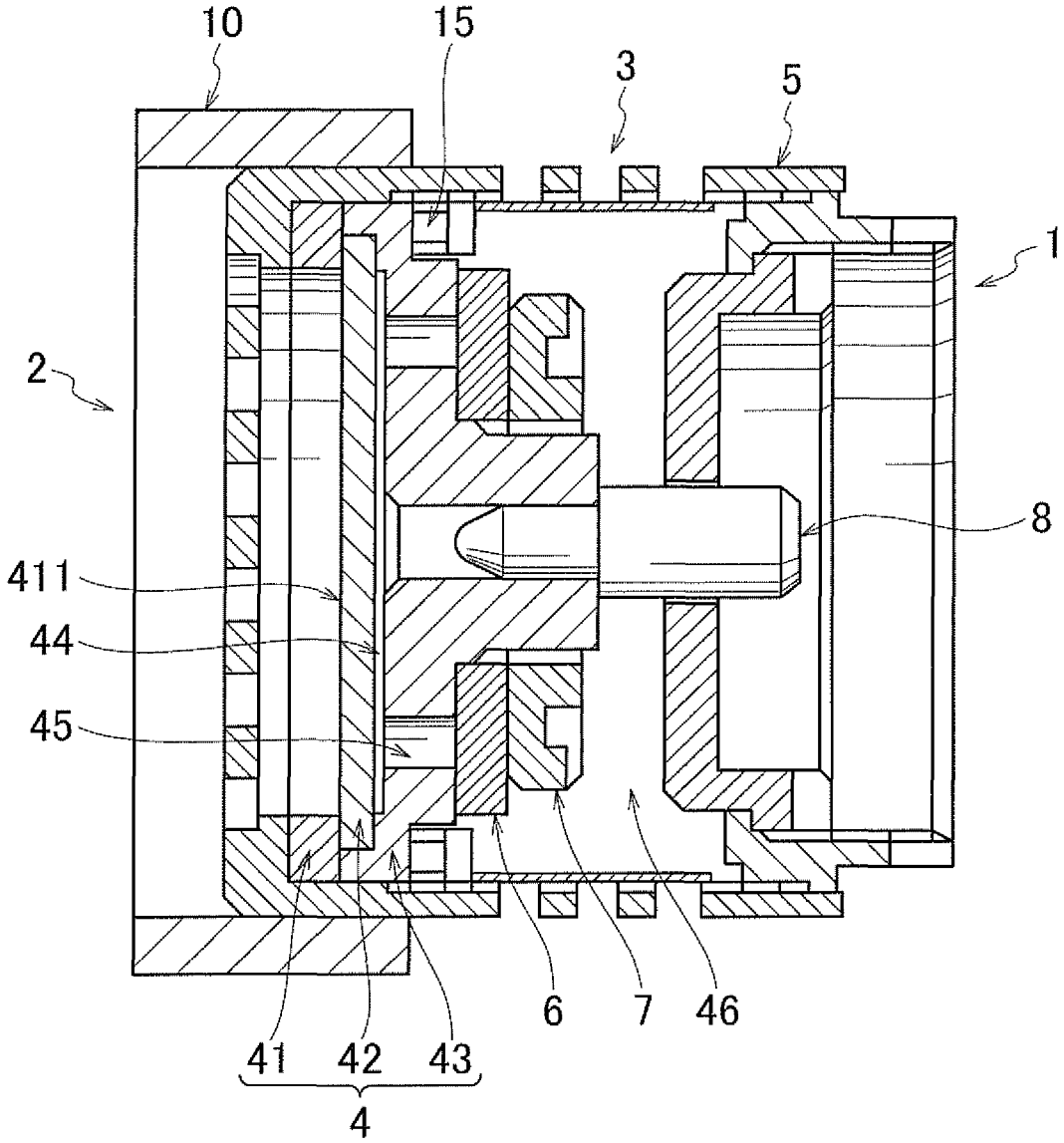
FIG. 9A is a longitudinal cross-sectional view of a unidirectional condenser microphone according to a second variation of the first embodiment.
Figure 9B:
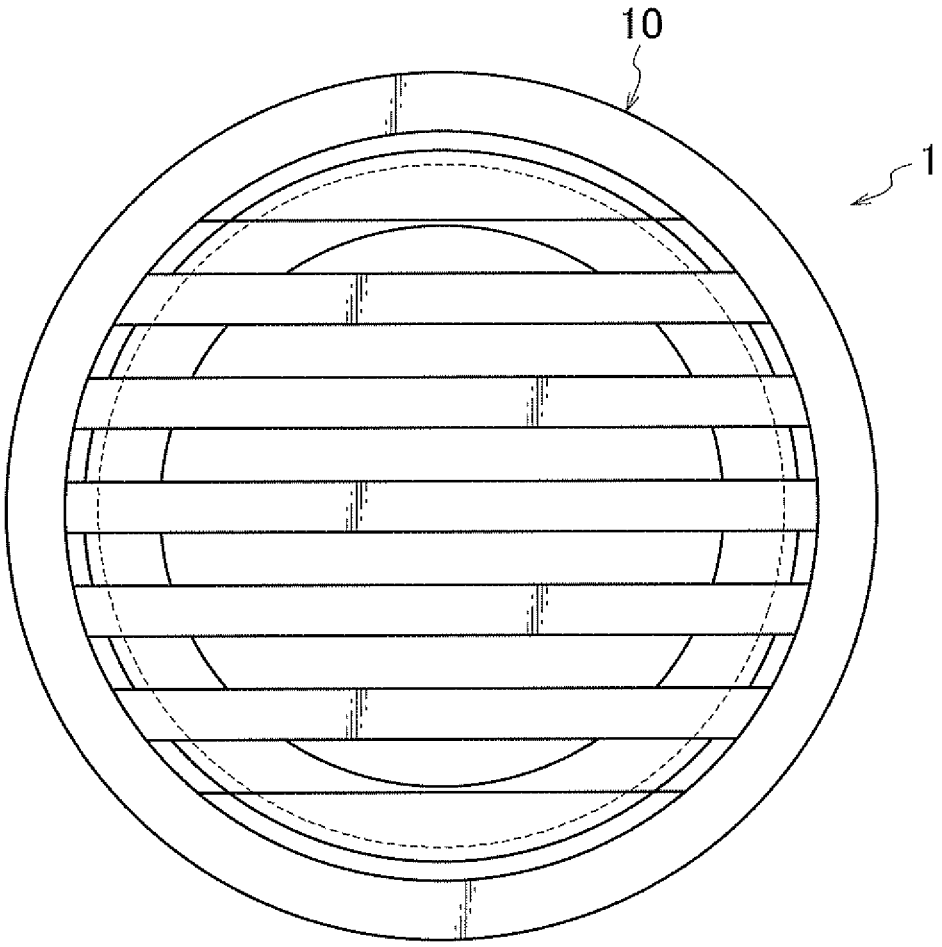
FIG. 9B is a front view according to the second variation.

FIGS. 9A and 9B illustrate the condenser microphone 1 including the directionality varying member 10 disposed at a position different from that described above and having directional characteristics of a hyper-cardioid pattern. In the case illustrated in FIG. 9A, the directionality varying member 10 is disposed ahead of the microphone case 5. The rear acoustic terminal 3 is opened, in other words, uncovered by the directionality varying member 10, and the front edge of the directionality varying member 10 protrudes ahead of the front edge of the microphone case 5. The inner configuration of the condenser microphone 1 is the same as that according to the two embodiments described above.

Figure 10:
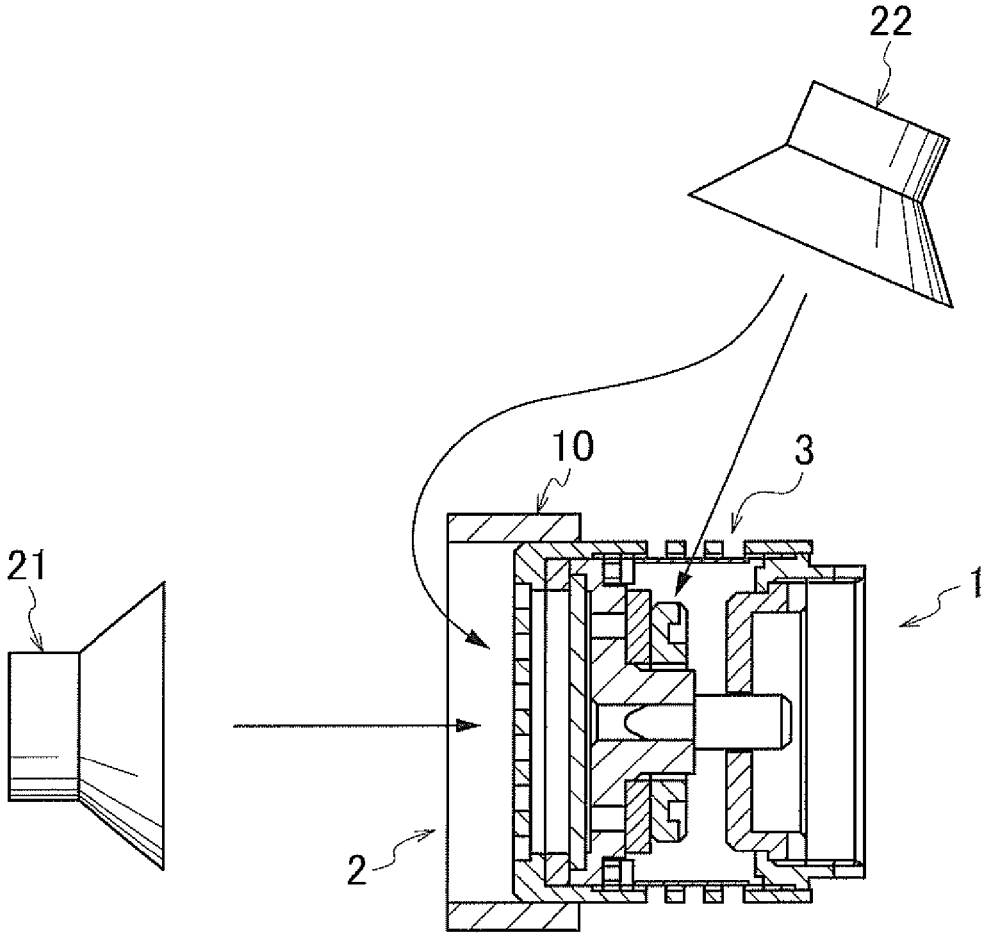
FIG. 10 is a model diagram illustrating the principle of sound pickup of the unidirectional condenser microphone according to the second variation.

FIG. 10 illustrates the principle of sound pickup of the condenser microphone 1 including the directionality varying member 10 disposed at the position illustrated in FIG. 9A. The sound source 21 is disposed ahead of the front acoustic terminal 2 of the condenser microphone 1, and the sound source 22 is disposed on the side of the rear acoustic terminal 3. In comparison with FIG. 1A illustrating a condenser microphone 1 having typical unidirectionality, the front acoustic terminal 2 of the condenser microphone 1 illustrated in FIG. 9A is displaced substantially forward to increase the distance between the front acoustic terminal 2 and the rear acoustic terminal 3. The rear acoustic terminal 3 is opened in the same way as illustrated in FIG. 1A. The sound from the sound source 21 disposed ahead of the front acoustic terminal 2 enters the front acoustic terminal 2 and is picked up. A part of the sound from the sound source 22 disposed on the side of the rear acoustic terminal 3 enters the rear acoustic terminal 3 and the other part of the sound passes through the directionality varying member 10 and being picked up by the front acoustic terminal 2.

Figure 11:
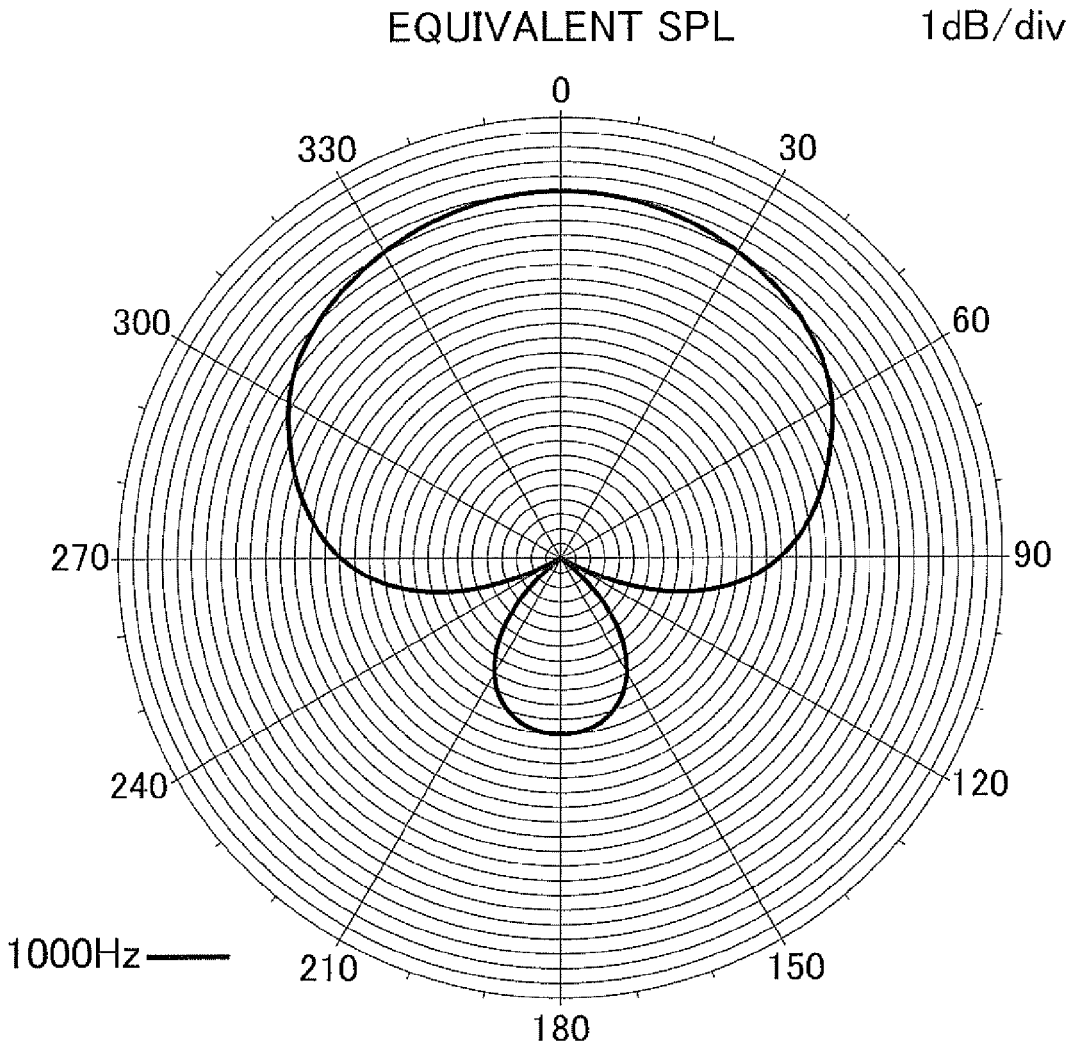
FIG. 11 is a directional characteristics diagram according to the second variation.
Figure 12:
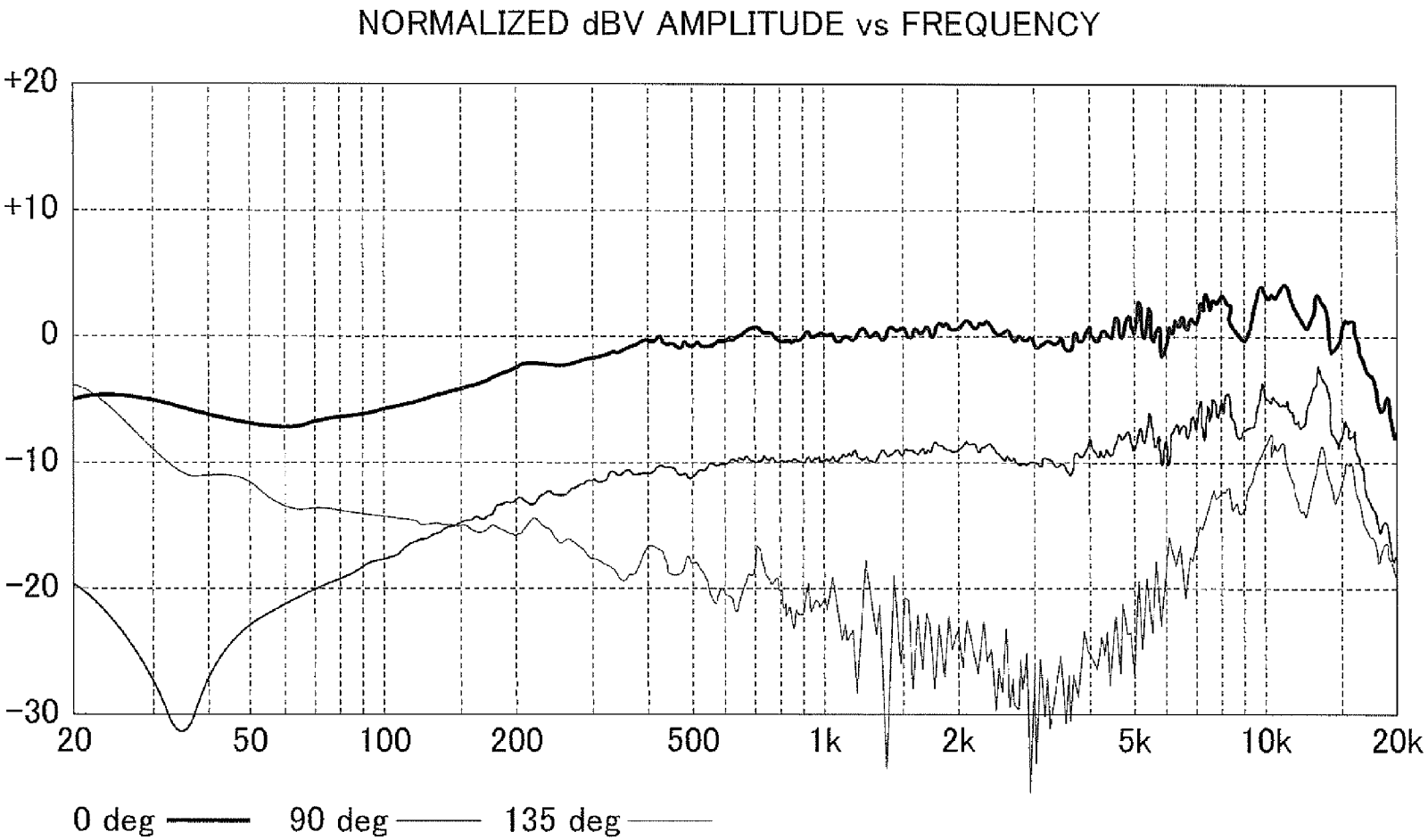
FIG. 12 is a frequency response diagram according to the second variation.

FIG. 11 illustrates the directional characteristics of the condenser microphone 1 having a directionality varying member 10 disposed at a position illustrated in FIG. 9A, and FIG. 12 illustrates the frequency response characteristics of the condenser microphone 1. The directionality varying member 10 disposed at the position illustrated in FIG. 9A picks up the sound from the forward sound source and the sound from sources other than the forward sound source. Thus, the bidirectional components increase, so that the directional characteristics have a hyper-cardioid pattern, as illustrated in FIG. 11.

The directionality varying member 10 disposed at the position illustrated in FIG. 9A increases the driving force of the bidirectional components so as to increase the sensitivity of the condenser microphone 1. As apparent from the frequency response characteristics illustrated in FIG. 12 in comparison with the frequency response characteristics illustrated in FIG. 4, the sensitivity and the frequency response are maintained. Thus, the voice of a specified speaker can be effectively picked up.

The front edge of the directionality varying member 10 disposed ahead of the front edge of the front acoustic terminal 2 limits the space in front of the front acoustic terminal 2. Thus, in general, the sound can readily resonate in this front space. The sound entering the directionality varying member 10, which functions as an acoustic resistor, leaks to the exterior through the directionality varying member 10 before resonating inside the front space. That is, the directionality varying member 10, functioning as an acoustic resistor, prevents the resonance, regardless of a decrease in the Q factor of the space in front of the front acoustic terminal 2 and a decrease in the space in front of the front acoustic terminal 2.

As described above, the condenser microphone 1 according to this embodiment has a unidirectional cardioid pattern and includes the directionality varying member 10. The position of the directionality varying member 10 of the condenser microphone 1 can be varied to switch the sub-cardioid pattern and the hyper-cardioid pattern. Thus, the appropriate directional characteristics can be selected during use in accordance with the purpose of use and the usage environment.

Protrusions to position the directionality varying member 10 may be provided on the outer circumferential surface of the microphone case 5 so that the directionality varying member 10 can be appropriately positioned in accordance with the directional characteristics. The protrusions are, for example, formed on the circumference ahead of the slits in the microphone case 5, which serves as the rear acoustic terminal 3. Such protrusions disposed in contact with the front end surface of the directionality varying member 10 covers the rear acoustic terminal 3. Such protrusions disposed in contact with the rear end surface of the directionality varying member 10 open the rear acoustic terminal 3, and the front end surface of the directionality varying member 10 protrudes ahead of the front surface of the microphone case 5. In this way, the front acoustic terminal 2 is displaced substantially ahead of the microphone case 5.

The unidirectional condenser microphone according to the embodiments described above can have variable directional characteristics by changing the position of the directionality varying member, which is composed of a porous material, attached to the microphone case. The directionality varying member covering the rear acoustic terminal provides a sub-cardioid pattern. If the directionality varying member opens the rear acoustic terminal and displaces the front acoustic terminal substantially ahead of the microphone case, the directional characteristics is a hyper-cardioid pattern.

A unidirectional condenser microphone according to another embodiment of the present invention and a directionality varying member for the condenser microphone will now be described with reference to FIGS. 13 and 14. In the embodiments illustrated in FIGS. 13 and 14, the condenser microphone 1 is equipped with a wind screen 11, which provides protection against wind. The wind screen 11 consists of a breathable member that covers the condenser microphone 1 to prevent noise generated by air flow.

Figure 13:
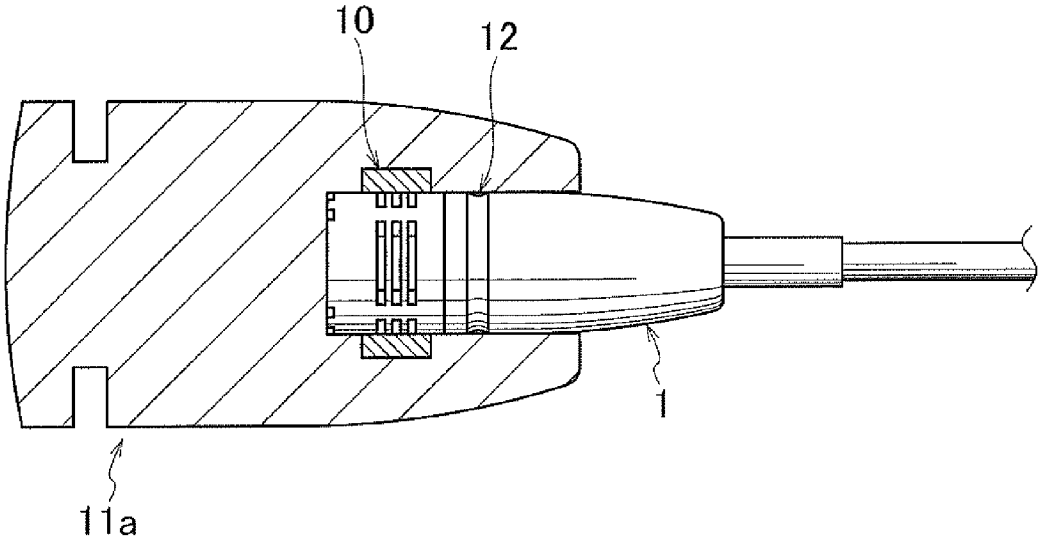
FIG. 13 is a longitudinal cross-sectional view of a unidirectional condenser microphone according to a second embodiment of the present invention.

As illustrated in FIG. 13, a wind screen 11*a* has a hole for attachment to the outer circumferential surface of the condenser microphone 1 and a directionality varying member 10 lining the inner circumferential surface. The directionality varying member 10 is composed of the same material and has the same shape, i.e., cylindrical shape as the directionality varying member 10 according to the embodiments described above. The inner circumferential surface of the directionality varying member 10 is substantially the same as the inner circumferential surface of the wind screen 11*a* and is fit into the wind screen 11*a*. As illustrated in FIG. 13, the directionality varying member 10 is positioned relative to the wind screen 11*a* such that the directionality varying member 10 covers the rear acoustic terminal 3 in a case where the wind screen 11*a* is installed in the condenser microphone 1.

Figure 14:
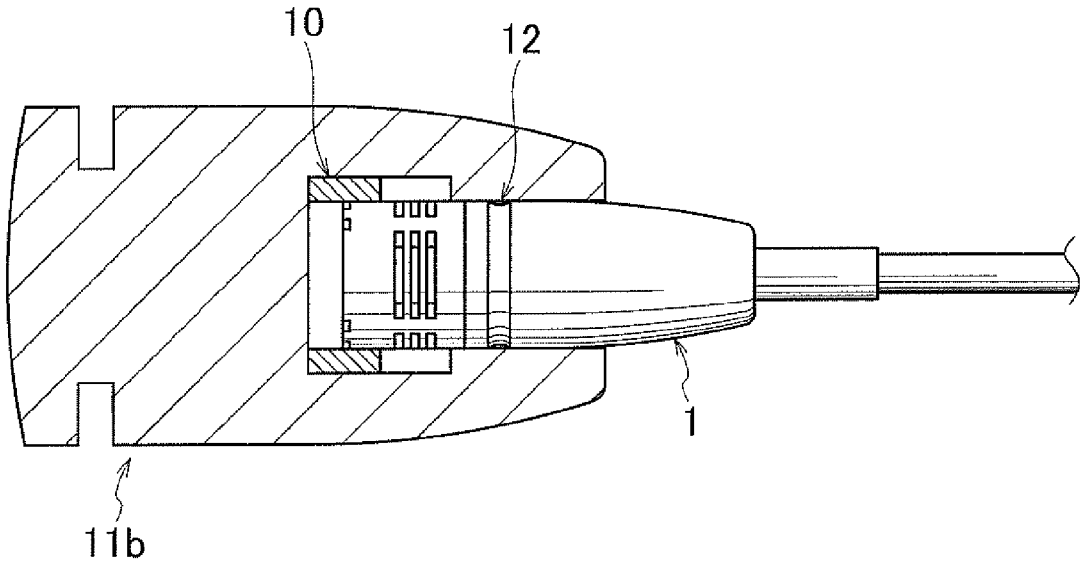
FIG. 14 is a longitudinal cross-sectional view of a unidirectional condenser microphone and a directionality varying member thereof according to a third embodiment of the present invention.

In the embodiment illustrated in FIG. 14, the directionality varying member 10 is positioned relative to a wind screen 11*b* installed in the condenser microphone 1 such that the directionality varying member 10 opens the rear acoustic terminal 3. The directionality varying member 10 is positioned relative to the wind screen 11*b*. As a result of this positioning, the front edge of the directionality varying member 10 protrudes forward from the front edge of the condenser microphone 1 such that the front acoustic terminal 2 is displaced substantially ahead of the rear acoustic terminal 3.

Figure 5B:
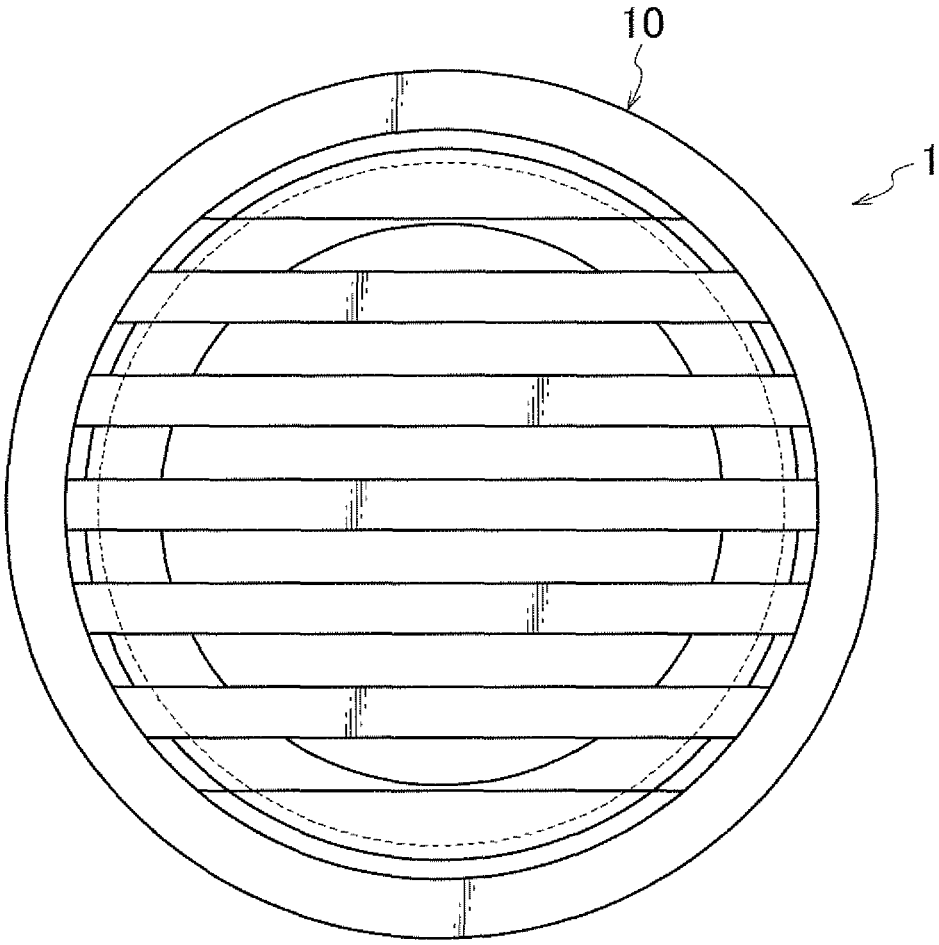
FIG. 5B is a front view of the unidirectional condenser microphone according to the first variation.

In the embodiment illustrated in FIG. 13, the condenser microphone 1 has directional characteristics of a sub-cardioid pattern, similar to that of the condenser microphone 1 illustrated in FIGS. 5A and 5B. In the embodiment illustrated in FIG. 14, the condenser microphone 1 has directional characteristics of a hyper-cardioid pattern, similar to that of the condenser microphone 1 illustrated in FIGS. 9A and 9B. One wind screen is selected from the wind screens having directionality varying members 10 at different installation positions and is installed on the unidirectional condenser microphone to achieve the selection of the directional characteristics.

A fixing portion for the wind screen 11 may be provided on the outer circumferential surface of the microphone case 5 such that the directionality varying member 10 is disposed at a desired position on the microphone case 5. In the embodiments illustrated in FIGS. 13 and 14, an annular member 12 that prevents the wind screen 11 from detaching from the condenser microphone 1 is embedded in the circumferential surface of the hole in the wind screen 11. The annular member 12 engages with a circumferential groove formed on the outer circumferential surface of the microphone case 5 to prevent detachment of the wind screen 11.

In a variation of the embodiment illustrated in FIGS. 13 and 14, a directionality varying member 10 integrated with the wind screen 11 slides on the microphone case 5. That is, the sliding of the wind screen 11 on the microphone case 5 changes the position of the directionality varying member 10. The sliding of the wind screen 11 switches the directionality varying member 10 between a position where the directionality varying member 10 covers the rear acoustic terminal 3 and another position where the rear acoustic terminal 3 is opened and the front acoustic terminal 2 is displaced ahead of the front surface of the microphone case 5.

What is claimed is:

1. A unidirectional condenser microphone comprising:

a front acoustic terminal disposed on a forward portion of a microphone case accommodating a condenser microphone unit;

a rear acoustic terminal disposed on an outer circumferential surface of the microphone case; and a directionality varying member, wherein the directionality varying member is disposed on the outer circumferential surface of the microphone case, the directionality varying member being switchable between a first position and a second position, the rear acoustic terminal being covered by the directionality varying member at the first position and being opened at the second position, and wherein the directionality varying member protrudes ahead of a front surface of the microphone case to open the rear acoustic terminal when the directionality varying member is disposed at the second position.

2. The unidirectional condenser microphone according to claim 1, wherein the directionality varying member comprises a sintered elastic porous material.

3. The unidirectional condenser microphone according to claim 1, wherein the directionality varying member slides on the microphone case in a longitudinal direction between the first position and the second position.

4. The unidirectional condenser microphone according to claim 1, further comprising:

positioning portions corresponding to the first and the second positions of the directionality varying member, the positioning portions being disposed on the outer circumferential surface of the microphone case.

5. The unidirectional condenser microphone according to claim 1, wherein the directionality varying member is accommodated in a wind screen attached to the microphone case.

6. The unidirectional condenser microphone according to claim 1, wherein the directionality varying member switches between the first and second positions as a result of replacement of a wind screen having an installation position corresponding to the first position with another wind screen having another installation position corresponding to the second position.

7. The unidirectional condenser microphone according to claim 6, further comprising:

fixing portions disposed on the outer circumferential surface of the microphone case, the fixing portions each fixing the wind screen to either the first or second position.

8. The unidirectional condenser microphone according to claim 1, wherein directional characteristics are sub-cardioid characteristics when the directionality varying member is disposed at the first position.

9. The unidirectional condenser microphone according to claim 1, wherein directional characteristics are hyper-cardioid characteristics when the directionality varying member is disposed at the second position.

10. A directionality varying member attached to a unidirectional condenser microphone, the unidirectional condenser microphone comprising:

a microphone case including a front acoustic terminal disposed on a forward portion of the microphone case; and a condenser microphone unit accommodated in the microphone case, wherein the directionality varying member is disposed on an outer circumferential surface of the microphone case and switches between a first position and a second position, the directionality varying member covering a rear acoustic terminal disposed on the outer circumferential surface of the microphone case at the first position, the rear acoustic terminal being opened at the second position, and wherein the directionality varying member protrudes ahead of a front surface of the microphone case to open the rear acoustic terminal when the directionality varying member is disposed at the second position.

* * * * *